US010446303B2

(12) United States Patent
Mizouchi et al.

(10) Patent No.: US 10,446,303 B2
(45) Date of Patent: Oct. 15, 2019

(54) COIL RESISTOR AND METHOD FOR MANUFACTURING SAME

(71) Applicant: KOA CORPORATION, Nagano (JP)

(72) Inventors: Yasuo Mizouchi, Nagano (JP); Ringo Kumagai, Nagano (JP); Kazunari Nebashi, Nagano (JP)

(73) Assignee: KOA Corporation, Nagano (JP)

( * ) Notice: Subject to any disclaimer, the term of this patent is extended or adjusted under 35 U.S.C. 154(b) by 0 days.

(21) Appl. No.: 16/323,151

(22) PCT Filed: Jun. 23, 2017

(86) PCT No.: PCT/JP2017/023293

§ 371 (c)(1),
(2) Date: Feb. 4, 2019

(87) PCT Pub. No.: WO2018/030003

PCT Pub. Date: Feb. 15, 2018

(65) Prior Publication Data

US 2019/0172614 A1 Jun. 6, 2019

(30) Foreign Application Priority Data

Aug. 10, 2016 (JP) ..... 2016-157863

(51) Int. Cl.

| | |
|---|---|
| ***H01C 17/04*** | (2006.01) |
| ***H01C 1/148*** | (2006.01) |
| ***H01C 3/20*** | (2006.01) |
| ***H01C 3/00*** | (2006.01) |

(Continued)

(52) U.S. Cl.

CPC ..... *H01C 17/04* (2013.01); *H01C 1/01* (2013.01); *H01C 1/148* (2013.01); *H01C 3/00* (2013.01); *H01C 3/20* (2013.01); *H01C 17/28* (2013.01)

(58) Field of Classification Search

CPC ..... H01C 17/04; H01C 1/148; H01C 3/20; H01C 17/28

See application file for complete search history.

(56) References Cited

U.S. PATENT DOCUMENTS 3,153,219 A * 10/1964 Street ..... H01C 1/148 338/273
3,319,210 A * 5/1967 Sandone, Jr. ..... H01C 1/148 174/75 R (Continued)

FOREIGN PATENT DOCUMENTS

JP 45-12524 Y2 6/1970
JP S50-31450 U1 4/1975

(Continued)

*Primary Examiner* — Kyung S Lee
(74) *Attorney, Agent, or Firm* — Carrier Blackman & Associates, P.C.; Joseph P. Carrier; William D. Blackman

(57) ABSTRACT

A single or multiple cutters are pressed against end surfaces of a resistive element so as to form a plurality of notches in rims of the end surfaces. At this time, notches are formed such that notch depth at the end surfaces of the resistive element toward the axis center is smaller than notch length from the end surfaces of the resistive element to the axis. This allows easy cutting and removal of the resistance wire at the resistive element ends of a coil resistor, etc., and prevention of fraying of a wound wire at the resistive element ends.

18 Claims, 4 Drawing Sheets

(51) Int. Cl.
*H01C 17/28* (2006.01)
*H01C 1/01* (2006.01)

(56) References Cited

U.S. PATENT DOCUMENTS

| | | | | | |
|---|---|---|---|---|---|
| 3,375,342 | A * | 3/1968 | Robinson | B23K 15/08 | 219/121.12 |
| 5,889,459 | A * | 3/1999 | Hattori | H01C 17/06533 | 338/9 |
| 8,203,422 | B2 * | 6/2012 | Naito | H01C 1/012 | 338/307 |
| 8,314,677 | B1 * | 11/2012 | Kuo | H01C 1/14 | 338/264 |
| 2002/0189342 | A1 * | 12/2002 | Ishiguro | G01F 1/69 | 73/204.26 |

FOREIGN PATENT DOCUMENTS

| | | | |
|---|---|---|---|
| JP | S50-82552 | A | 7/1975 |
| JP | S59-115501 | A | 7/1984 |
| JP | 64-53501 | A | 3/1989 |
| JP | 5-129114 | A | 5/1993 |
| JP | 2016-001758 | A | 1/2016 |

* cited by examiner

COIL RESISTOR AND METHOD FOR MANUFACTURING SAME

TECHNICAL FIELD

The present invention relates to a coil resistor having a wave noise restraining function, for example, and a manufacturing method thereof.

BACKGROUND ART

The coil resistor is used in applications; such as in a power supply circuit as a current limiting resistor for preventing a rush current at the time of supplying power; as a heat-resistant element when housed in a ceramic case; and as a noise preventing resistor through its filtering function due to having a resistance component and an inductance component, wherein the heat-resistant element may effectively control emission of high frequency noise generated at the time of igniting an automobile engine, for example. Said coil resistor is manufactured by winding a resistance wire around the outer side of a core made of a long fiber bundle, for example, and cutting to an appropriate length, and then press-fitting cap electrodes onto either end part thereof or caulking and attaching thereon.

Patent Document 1 discloses a resistor made by continuously winding a resistance wire on a core of bundled glass fibers. More specifically, multiple consecutive insulators such as glass fibers are bundled, impregnated with a heat-resistant adhesive such as a silicone varnish, and the resistance wire using carbon wire thread is continuously wound thereon. Once a thin coating of the silicone varnish is further applied on the surface of the wound body, it is baked and cured, and then dried, and thereafter cut to the length of the individual resistive elements.

Patent Document 2 discloses a manufacturing method for a resistor made up of multiple cap terminals and connecting parts electrically connecting adjacent cap terminals; wherein the cap terminals are each put and caulked on an end of respective resistive elements cut to an appropriate length, which are made by winding a resistance wire around the outer side of twisted glass fibers, thereby housing respective terminal parts of the multiple resistive elements. The cap terminals are positioned on the same surface perpendicular to the axial direction of the resistive elements.

PRIOR ART DOCUMENTS

Patent Documents

Patent Document 1: JP Sho 59-115501A
Patent Document 2: JP 2016-001758A

DISCLOSURE OF THE INVENTION

Problem to be Solved by the Invention

Since the core made of a fiber bundle in the aforementioned coil resistor is flexible, it is difficult to wind the resistance wire after cutting it to a predetermined length, and therefore the resistance wire is wound on as is in a long state. For example, the fiber bundle form is maintained by impregnating the core with a binder such as resin so as to secure it, and transporting it to the next process while pulling the core. Moreover, when cutting the long core to a predetermined length, it is secured by applying a resin coating etc. in a thickness that hides the resistance wire.

However, wire end portions of the resistance wire on the cut surface of the core may be frayed on contact with the cutter when cutting the core, transporting to the next process, etc. Moreover, there is a problem that if cap electrodes are fit while wire end portions of the resistance wire are frayed, the frayed resistance wire is pushed into the cap electrodes due to the force pushing the core on to the cap electrodes, thereby projecting out from the electrode. If the resistor is used without removing the resistance wire that has projected out in this way, there is a chance that a defect such as a short circuit of the circuit integrating the resistor is induced, and a device etc. on which the resistor is mounted does not function normally, thereby not being able to fully function.

However, in the case of cutting wire end portions of the resistance wire using laser radiation, for example, as end surface processing of the resistor, there is a problem that a high power is required and longer time is necessary for processing. On the other hand, with the method of heating while pressing the resistance wire and then cutting etc., there is a problem that the resistance wire is not completely cut and remains, thereby not allowing sufficient removal of the resistance wire at the end parts.

The present invention is made in light of the problem mentioned above. The present invention aims to provide a coil resistor in which the resistance wire near resistive element end parts may be easily cut and removed and which fraying of a wound wire at the end parts may be prevented. The present invention also aims to provide a manufacturing method of the coil resistor, and a machining device thereof.

Means of Solving the Problem

The present invention aims to resolve the above problems, and includes the following structure, for example, as means for achieving the above aim. That is, a coil resistor made by attaching a cap electrode on either end part of a resistive element formed by winding a resistance wire around the circumference of a core that is formed by twisting together fibrous insulating material, comprising a plurality of notches of a predetermined length formed along the axis of the resistive element on rims of either end surface of the resistive element.

For example, it is characterized in that the resistance wire is cut at the rims. Further, for example, it is also characterized in that the plurality of notches is formed at nearly equal intervals along the circumference of the rims, and the intervals of the notches along the circumference are shorter than depth of the cap electrode toward the axis. Moreover, it is characterized in that depth of the plurality of notches toward the axis center of the resistive element is deepest near the axial end part of a peripheral surface of the resistive element, and becomes shallower as the notches approach the central part along the axis of the peripheral surface from the end parts.

For example, it is characterized in that depth of the plurality of notches toward the axis center of the resistive element is the same depth at a notch starting point in the axial end part of a peripheral surface of the resistive element and at a notch ending point at a predetermined distance from the end part along the axis. Further, for example, it is characterized in that the plurality of notches is formed within a range of less than 10% of the region of the peripheral surface of the resistive element that is covered by the cap electrode.

Furthermore, a manufacturing method for a coil resistor is characterized by including the steps of: twisting together fibrous insulating material to form a long core; winding a resistance wire around the circumference of the core; cutting at a predetermined length the core around which the resistance wire is wound, so as to form a resistive element; forming a plurality of notches of a predetermined length along the axis of the resistive element in rims of either end surface of the resistive element; and attaching a cap electrode on either end part of the resistive element.

Further, it is characterized in that in the step of forming the plurality of notches, the resistance wire at the rims is cut. Yet further, it is characterized in that in the step of forming the plurality of notches, the plurality of notches is formed in a plurality of places simultaneously in the rims of either end surface of the resistive element.

Yet even further, it is characterized in that the plurality of notches is formed at nearly equal intervals along the circumference of the rims, and the intervals of the notches along the circumference are shorter than depth of the cap electrodes toward the axis. Yet even further, it is characterized in that the plurality of notches is formed within a range of less than 10% of the region of the peripheral surface of the resistive element that is covered by the cap electrode.

Results of the Invention

According to the present invention, fraying of a wound wire at the end parts of the coil resistor may be prevented by surely and quickly cutting and removing a resistance wire in the vicinity of the end parts of the resistive element.

DESCRIPTION OF EMBODIMENTS

Figure 1:
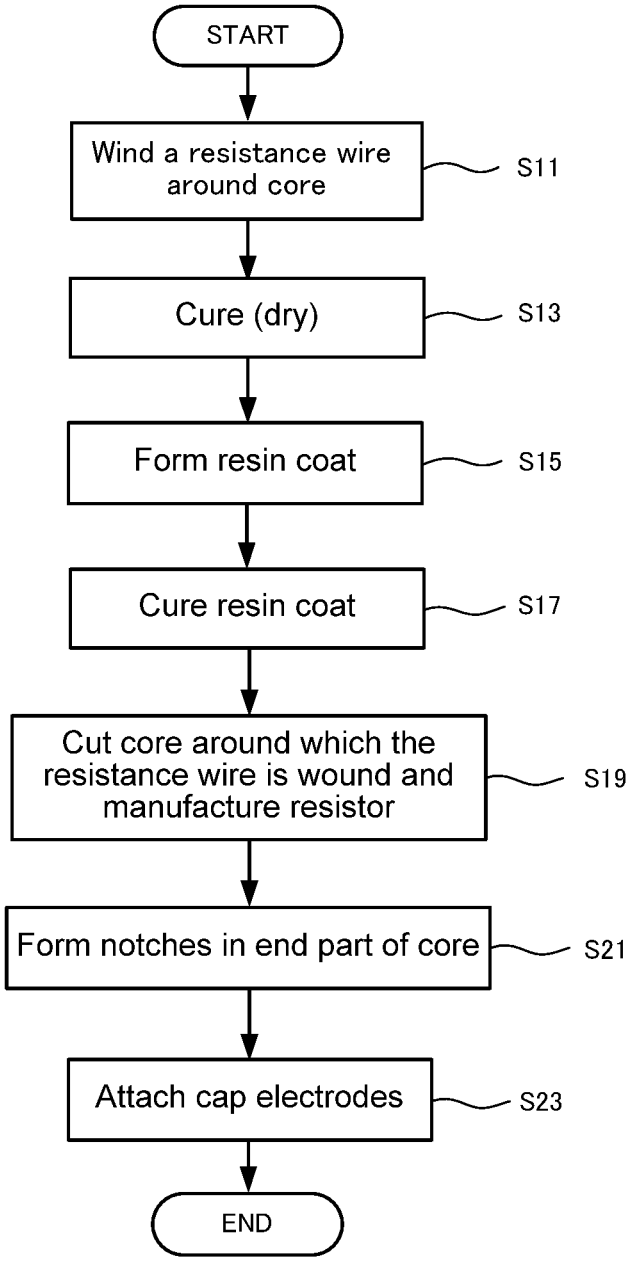
FIG. 1 is a flowchart representing in a time series a manufacturing process of a coil resistor according to an embodiment of the present invention.

An embodiment according to the present invention is described in detail below with reference to accompanying drawings. FIG. 1 is a flowchart representing in a time series a manufacturing process of a coil resistor according to an embodiment of the present invention. In addition, FIG. 2 shows an exploded view and an external view of the coil resistor according to the embodiment, and FIG. 3 illustrates a cross-sectional structure etc. of the coil resistor.

In step S11 of FIG. 1, a resistance wire is wound around the circumference of a core formed by twisting together fibrous insulating material. The core is a member resulting from bundling together multiple fibers made of an insulating material such as glass, ferrite, resin, or aluminum having a fiber diameter of several microns (several μm to several tens of μm), for example, impregnating with epoxy resin or silicone resin, and forming a long rod-like form.

Note that there are cases where the core is bent without being able to maintain the core shape when transported in a long state before the core is cut in the manufacturing process. Therefore, as described above, it is impregnated with epoxy resin, silicone resin, etc. and heat-cured so as to maintain its shape.

The resistance wire wound around the core circumference is a metal wire such as a nickel-iron alloy (Ni—Fe) wire, a nickel (Ni) wire, a chrome (Cr) wire, or a nickel-chrome alloy (Ni—Cr) wire, for example, and has a wire diameter of several tens of μm, for example. In this case, the resistance wire is wound around the core continuously at a predetermined pitch (e.g., a narrow pitch). Note that a metal wire may be used as the resistance wire as is or have a resin coating formed around the periphery.

In step S13, as described above, the core around which the resistance wire is wound and then impregnated with resin is dried so as to cure the resin. The method of curing the resin may be any one of curing at room temperature, heat curing (e.g., 100° C. to 150° C.), or curing using ultraviolet irradiation.

In step S15, for example, epoxy resin or silicon resin is coated in a thickness that hides the resistance wire on the surface of the core that is dried and cured in step S13 so as to form a resin coat. The resin coat is then cured in step S17. This fixes the resistance wire on the core surface.

In step S19, the long core wound with the resistance wire and coated with resin as described above is cut at a predetermined length using a cutter, thereby manufacturing individual resistors (resistive elements). In the following step S21, a cutting instrument (cutter) is placed perpendicular to an end surface (cut section) of the resistive element, for example, so as to form notches in a part of the core and the resistance wire (several turns of the wire). In this notch formation method, a part of the resistance wire is cut off, exposing end parts of the core.

Figure 2A:
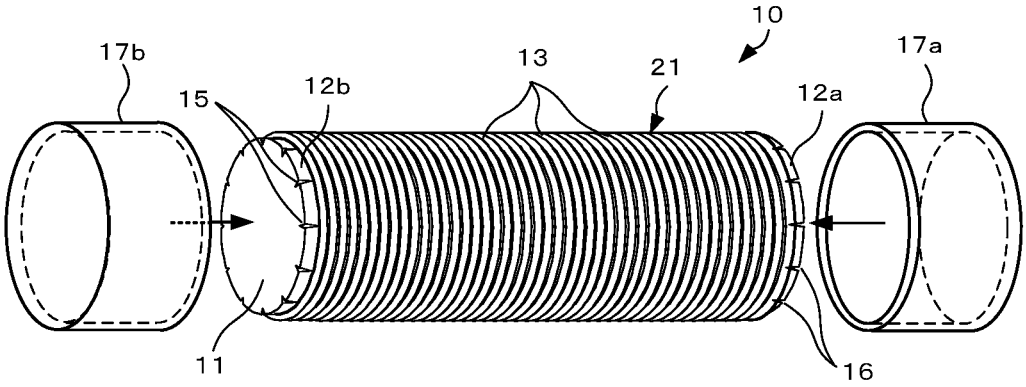
FIGS. 2A and 2B show an exploded view and an external view of the coil resistor according to the embodiment.

FIG. 2A is an exploded view of the coil resistor according to the embodiment. A resistive element 21 as illustrated in FIG. 2A has a resistance wire cut off at end parts (rims 12*a*, 12*b*) on the peripheral surface of a core 11 around which a resistance wire 13 is wound, thereby exposing the end parts of the core as described in the notch formation process of the aforementioned step S21. Moreover, multiple notches 15 and 16 are formed consecutively in the rims 12*a* and 12*b* on either end of the core 11 along the circumference.

Figure 2B:
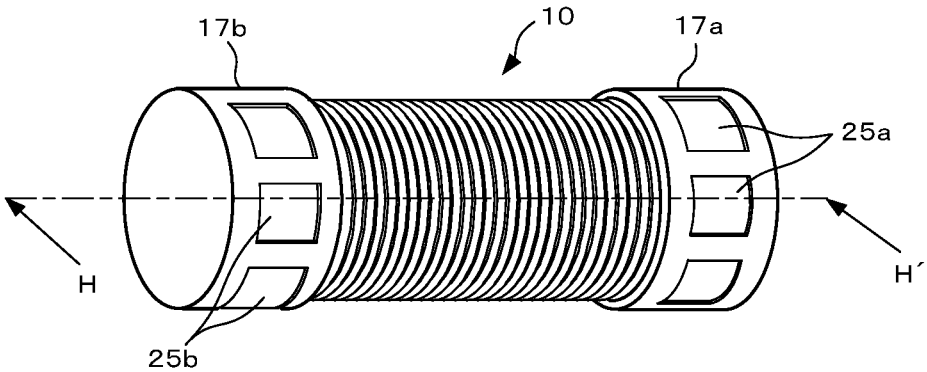

In step S23, once cap electrodes 17*a* and 17*b* are mechanically pressed in either end part in the axial directions of the resistive element 21 or directions indicated by arrows in FIG. 2A and attached, the cap electrodes are pressed from the peripheral surface so as to be deformed (caulked) and fixed. As a result, caulking marks 25*a* and 25*b* are formed through the caulking in the periphery of the cap electrodes 17*a* and 17*b* of a coil resistor 10, as illustrated in FIG. 2B. The cap electrodes 17*a* and 17*b* are bottomed cylindrical members having an opening on one end and made of a conductive metal such as iron or stainless steel, for example. Copper, nickel etc. are plated on the surface of the metal.

Next, details of the form of the notches formed in the rim of either end surface of the resistive element in the coil resistor according to the embodiment are described.

<First Notch Formation Example>

Figure 3A:
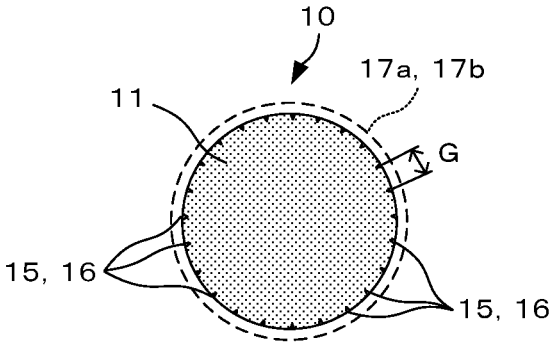
FIGS. 3A and 3B illustrate a cross-sectional structure etc. of the coil resistor, according to the embodiment, and is an example of notch formation (first notch formation example) in the resistive element.
Figure 3B:
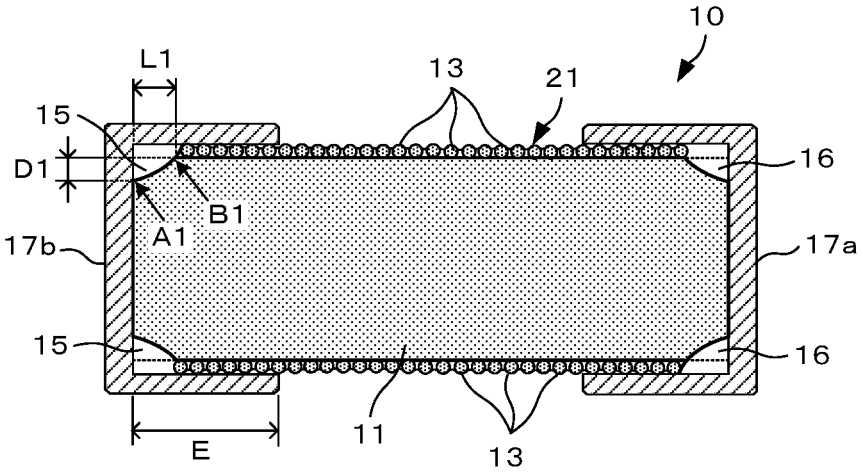

FIG. 3A is a side view of the coil resistor according to the embodiment when viewed from the axial direction. FIG. 3B is a cross-section of the coil resistor of FIG. 2B cut along a line between arrows H-H' in the longitudinal direction, illustrating details of a first notch formation example. The resistance wire 13 is omitted in FIG. 3A. In the coil resistor according to the embodiment, the notches 15 and 16 are formed consecutively along the axis perpendicularly to an end surface (cut surface) of the resistive element 21 that is cut to a predetermined length as illustrated in FIGS. 3A and 3B. These notches 15 and 16 are formed by placing a disk-shaped cutter, for example, perpendicularly to the end surface of the core 11.

The notches 15 and 16 formed along the axis of the resistive element 21 cut a part (equivalent to several turns) of the resistance wire 13 in the vicinity of the circumferential edge of the resistive elements, and a part thereof further falls off naturally, thereby being eliminated. Accordingly, length L1 of the notches 15 and 16 shown in FIG. 3B is set as a length allowing formation of notches within a range of less than 10% of a region of the peripheral surface of the resistive element 21 that is covered by the cap electrodes 17*a* and 17*b*, for example. It is desired that this length L1 is, for example, within a range less than five turns (winds) of the resistance wire of the resistive element end part, and that the length is a value allowing at least resistance wire equivalent to three turns from the end part be cut off. Note that removal of the resistance wire can be done by sweeping them off using a brush or the like.

Moreover, depth D1 of the notches 15 and 16 (depth from the peripheral surface of the resistive element 21 toward the central axis) is deepest near the end surface of the resistive element 21 (indicated by reference numeral A1 in FIG. 3B), and as indicated by reference numeral B1 in FIG. 3B, it becomes shallower as it approaches the central part from the axial end part of the peripheral surface.

Furthermore, as shown in FIG. 3A etc., the notches 15 and 16 are formed in at least five or more places at nearly equal intervals along the circumferential edge of the core 11. Interval G between adjacent notches is determined, even when a resistance wire after cutting is still adhered to the end parts of the core 11 without being removed, by the cut length of the resistance wire that allows the unremoved resistance wire to fit in the cap electrodes so as not to fly outside.

More specifically, the number of the notches 15 and 16 on the circumferential edge of the core 11 is adjusted such that length of the cut off resistance wire is less than or equal to the axial depth of the cap electrodes (indicated by reference numeral E in FIG. 3B). For example, when a combined diameter of the resistance wire and the core of the coil resistor is 3.8 mm, the circumference is 3.8 mm×π=11.94 mm, and as a result, the length of the cut off resistance wire (interval between notches) is 11.94 mm/5=2.388 mm when forming the notches in five places.

The notch length L obtained in this manner is shorter than the depth (e.g., 2.7 mm) of the cap electrodes. Accordingly, even if the cut off resistance wire is adhered near the end parts of the core, or a part is left uncut, it is difficult for it to fly outside of the cap electrode. Note that since the length of the cut off resistance wire becomes shorter as the number of notch places is increased, a smaller notch interval is desired.

<Second Notch Formation Example>

Figure 4:
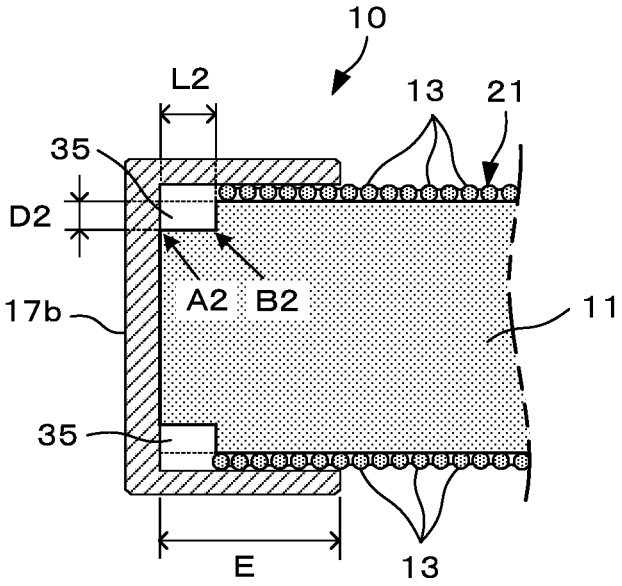
FIG. 4 illustrates another example of notch formation (second notch formation example) in the resistive element.

FIG. 4 illustrates details of a second notch formation example of the coil resistor according to the embodiment, and is a partial cross section of the coil resistor cut along a line between arrows H-H' in the longitudinal direction, similarly to FIG. 2B. A side view when viewed from the axial direction of the coil resistor illustrated in FIG. 4 is the same as FIG. 3A, and is omitted from the drawing.

With the coil resistor shown in FIG. 4, pressing a straight blade cutter, for example, perpendicularly against each of the end surfaces of the core 11 or simultaneously against either end surface of the core 11 forms notches 35 consecutively along the axis perpendicularly to the end surface (cut surface) of the resistive element 21. In the case of the second notch formation example, notch depth D2 toward the central axis of the resistive element 21 is the same near the end surface (indicated by reference numeral A2 in FIG. 4, and also called notch starting point) of the resistive element 21 and at places (indicated by reference numeral B2 in FIG. 4) at a predetermined distance from the end surface (L2 described later) along the axis.

Moreover, in the second notch formation example, the notches 35 are formed such that the notch depth (D2) to the central axis at the end part of the resistive element 21 is smaller than the notch length (L2) along the axis from the end surface of the resistive element 21 (L2>D2.)

In this manner, the second notch formation example offers an advantage that even if, for example, hardness differs between respective regions of the core due to the resin impregnated state etc. in which the resin has impregnated into the core of the resistive element, the resistance wire at the end parts of the resistive element can be surely cut since notch forms are made perpendicularly to the end surface of the resistive element along the axis. Furthermore, since the amount of cutting depth (notch depth D2 to the central axis at A2) into the end surface from the outside of the resistive element can be set low, work of notch formation may be performed quickly and effectively.

<Third Notch Formation Example>

Figure 5:
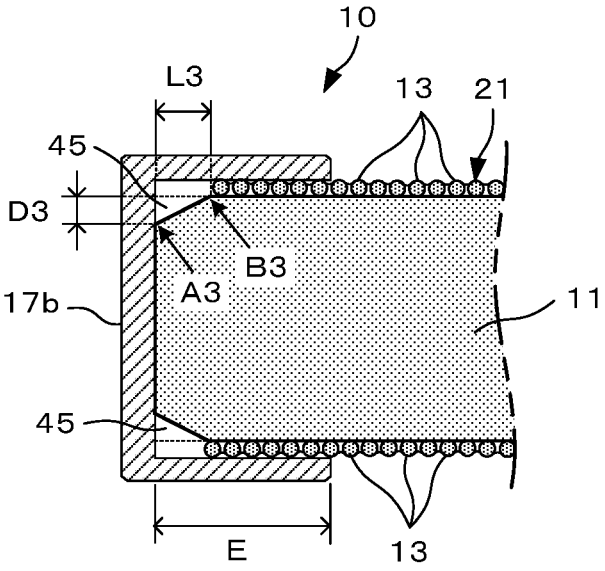
FIG. 5 illustrates another example of notch formation (third notch formation example) in the resistive element.

FIG. 5 illustrates details of a third notch formation example of the coil resistor according to the embodiment, and is a partial cross section of the coil resistor cut along a line between arrows H-H' in the longitudinal direction, similarly to FIG. 2B. A side view when viewed from the axial direction of the coil resistor is also the same as FIG. 3A, and is omitted from the drawing.

With the coil resistor shown in FIG. 5, for example, a straight blade cutter is pressed at a predetermined angle against each of the end surfaces of the core 11 or simultaneously against either end surface of the core 11 so as to form notches 45 consecutively along the axis from the end surfaces (cut surfaces) of the resistive element 21. In the case of the third notch formation example, as in the first notch formation example, notch depth D3 toward the axis center from the peripheral surface of the resistive element 21 is deepest near the end surface (indicated by reference numeral A3 in FIG. 5) of the resistive element 21, and as indicated by reference numeral B3, it becomes shallower as it approaches the central part from the axial end part of the peripheral surface. However, it differs from the first notch formation example in that the cross-sectional form of notch parts from A3 to B3 is linear.

That is, the first notch formation example described above has an arc-shaped notch cross-sectional form from A1 to B1, as illustrated in FIG. 3B, and the third notch formation example has a linear cross-sectional form, as illustrated in FIG. 5. This allows setting the amount of cutting depth (notch depth D3 toward the central axis at A3) into the end surface from the outside of the resistive element to be lower.

Note that in any of the first to third notch formation examples described above, for example, pressing a single or multiple disk-shaped cutters, or a single or multiple straight blade cutters against the end surfaces of the resistive element simultaneously may form multiple notches simultaneously in the rims of the end surfaces of the resistive element. Moreover, for example, once multiple cutters are rotated at a predetermined angle around the long axis of the resistive element as a central axis, pressing them against the end surfaces of the resistive element again may further form multiple notches in the rims of the end surfaces of the resistive element. As a result, notches may be formed in multiple places simultaneously in one process, thereby allowing reduction in notch processing time.

Furthermore, there is no problem even if roundness along the cross section of the core is lower since a cutting instrument (cutter) is inserted at a right angle in the end surface of the resistive element, notches are formed consecutively up to the core in the circumferential edge of the end surface of the resistive element, and the resistance wire is cut and removed.

According to the embodiment described above, formation of notches in multiple places in the circumferential edge of either end surface of the resistive element, and cutting and removal of the resistance wire at predetermined intervals on the circumferential edge can be carried out simultaneously. As a result, reduction of time necessary for forming notches and then processing resistance wire ends is possible, and a coil resistor that can surely prevent fraying of the wound wire at the end parts of the coil resistor may be provided.

Moreover, amount of cutting into the end surface from the outside of the resistive element, that is, notch depth toward the central axis of the resistive element may be set lower, and work of notch formation in the circumferential edge of the end surfaces of the resistive element may be performed quickly and effectively.

EXPLANATION OF REFERENCES

D1-D3: Notch depth
E: Depth of cap electrode
G: Notch interval
L1-L3: Notch length
10: Coil resistor
11: Core
12*a*, 12*b*: Rim
13: Resistance wire
15, 16, 35, 45: Notch
17*a*, 17*b*: Cap electrode
21: Resistive element
25*a*, 25*b*: Caulking mark

The invention claimed is:

1. A coil resistor made by attaching a cap electrode on either end part of a resistive element formed by winding a resistance wire around the circumference of a core that is formed by twisting together fibrous insulating material, comprising a plurality of notches of a predetermined length formed along the axis of the resistive element on rims of either end surface of the resistive element.

2. The coil resistor according to claim 1, wherein the resistance wire is cut at the rims.

3. The coil resistor according to claim 1, wherein the plurality of notches is formed at substantially equal intervals along the circumference of the rims, and the intervals of the notches along the circumference are shorter than depth of the cap electrode toward the axis.

4. The coil resistor according to claim 1, wherein depth of the plurality of notches toward the axis center of the resistive element is deepest near the axial end part of a peripheral surface of the resistive element, and becomes shallower as the notches approach the central part along the axis of the peripheral surface from the end parts.

5. The coil resistor according to claim 1, wherein depth of the plurality of notches toward the axis center of the resistive element is the same depth at a notch starting point in the axial end part of a peripheral surface of the resistive element and at a notch ending point at a predetermined distance from the end part along the axis.

6. The coil resistor according to claim 1, wherein the plurality of notches is formed within a range of less than 10% of the region of the peripheral surface of the resistive element that is covered by the cap electrode.

7. A manufacturing method for a coil resistor comprising the steps of:

twisting together fibrous insulating material to form a long core;

winding a resistance wire around the circumference of the core;

cutting at a predetermined length the core around which the resistance wire is wound, so as to form a resistive element;

forming a plurality of notches of a predetermined length along the axis of the resistive element in rims of either end surface of the resistive element; and attaching a cap electrode on either end part of the resistive element.

8. The manufacturing method for a coil resistor according to claim 7, wherein in the step of forming the plurality of notches, the resistance wire at the rims is cut.

9. The manufacturing method for a coil resistor according to claim 7, wherein in the step of forming the plurality of notches, the plurality of notches is formed in a plurality of places simultaneously in the rims of either end surface of the resistive element.

10. The manufacturing method for a coil resistor according to claim 7, wherein the plurality of notches is formed at substantially equal intervals along the circumference of the rims, and the intervals of the notches along the circumference are shorter than depth of the cap electrode toward the axis.

11. The manufacturing method for a coil resistor according to claim 7, wherein the plurality of notches is formed within a range of less than 10% of the region of the peripheral surface of the resistive element that is covered by the cap electrode.

12. The coil resistor according to claim 2, wherein the plurality of notches is formed within a range of less than 10% of the region of the peripheral surface of the resistive element that is covered by the cap electrode.

13. The coil resistor according to claim 3, wherein the plurality of notches is formed within a range of less than 10% of the region of the peripheral surface of the resistive element that is covered by the cap electrode.

14. The coil resistor according to claim 4, wherein the plurality of notches is formed within a range of less than 10% of the region of the peripheral surface of the resistive element that is covered by the cap electrode.

15. The coil resistor according to claim 5, wherein the plurality of notches is formed within a range of less than 10% of the region of the peripheral surface of the resistive element that is covered by the cap electrode.

16. The manufacturing method for a coil resistor according to claim 8, wherein the plurality of notches is formed within a range of less than 10% of the region of the peripheral surface of the resistive element that is covered by the cap electrode.

17. The manufacturing method for a coil resistor according to claim 9, wherein the plurality of notches is formed within a range of less than 10% of the region of the peripheral surface of the resistive element that is covered by the cap electrode.

18. The manufacturing method for a coil resistor according to claim 10, wherein the plurality of notches is formed within a range of less than 10% of the region of the peripheral surface of the resistive element that is covered by the cap electrode.

* * * * *